US005985206A

United States Patent [19]

Zabala et al.

[11] Patent Number: 5,985,206

[45] Date of Patent: Nov. 16, 1999

[54] ELECTROSLAG REFINING STARTER

[75] Inventors: Robert John Zabala, Schenectady; Bruce Alan Knudsen, Amsterdam; William Thomas Carter, Jr., Galway; Mark Gilbert Benz, Burnt Hills, all of N.Y.

[73] Assignee: General Electric Company, Schenectady, N.Y.

[21] Appl. No.: 08/996,712

[22] Filed: Dec. 23, 1997

[51] Int. Cl.[6] ..... C21C 1/00

[52] U.S. Cl. ..... 266/202; 75/10.24

[58] Field of Search ..... 266/202, 216; 75/10.24; 373/45

[56] References Cited

U.S. PATENT DOCUMENTS

| | | | |
|---|---|---|---|
| 3,715,201 | 2/1973 | Schlatter | 75/10.24 |
| 4,006,285 | 2/1977 | Steinman, Jr. et al. | 373/45 |
| 5,160,532 | 11/1992 | Benz et al. . | |
| 5,310,165 | 5/1994 | Benz et al. . | |
| 5,325,906 | 7/1994 | Benz et al. . | |
| 5,332,197 | 7/1994 | Benz et al. . | |
| 5,348,566 | 9/1994 | Sawyer et al. . | |
| 5,366,206 | 11/1994 | Sawyer et al. . | |

OTHER PUBLICATIONS

"Electroslag Remelting as a Liquid Metal Source for Spray Forming", Carter, Jr. et al., May 14–17, 1995 International Conference on Powder Metallurgy and Particulate Processing, pp. 1–9.

*Primary Examiner*—Scott Kastler

*Attorney, Agent, or Firm*—Ernest G. Cusick; Noreen C. Johnson

[57] ABSTRACT

An electroslag refining starter includes a refined disk fixedly joined in a central aperture of a mounting ring. The mounting ring supports the starter in a crucible below an ingot being electroslag refined. The disk is consumed during starting and is replaceable in the same mounting ring for subsequent reuse.

5 Claims, 4 Drawing Sheets

ELECTROSLAG REFINING STARTER

BACKGROUND OF THE INVENTION

The present invention relates generally to electroslag refining, and, more specifically, to electroslag refining of superalloys.

Electroslag refining (ESR) is a process used to melt and refine a wide range of alloys for removing various impurities therefrom. U.S. Pat. No. 5,160,532-Benz et al. discloses a basic electroslag refining apparatus over which the present invention is an improvement. Typical superalloys which may be effectively refined using electroslag refining include those based on nickel, cobalt, zirconium, titanium, or iron, for example. The initial, unrefined alloys are typically provided in the form of an ingot which has various defects or impurities which are desired to be removed during the refining process to enhance metallurgical properties thereof including oxide cleanliness, for example.

In a conventional electroslag apparatus, the ingot is connected to a power supply and defines an electrode which is suitably suspended in a water cooled crucible containing a suitable slag corresponding with the specific alloy being refined. The slag is heated by passing an electric current from the electrode through the slag into the crucible, and is maintained at a suitable high temperature for melting the lower end of the ingot electrode. As the electrode melts, a refining action takes place with oxide inclusions in the ingot melt being exposed to the liquid slag and dissolved therein. Droplets of the ingot melt fall through the slag by gravity and are collected in a liquid melt pool at the bottom of the crucible. The slag, therefore, effectively removes various impurities from the melt to effect the refining thereof.

The refined melt may be extracted from the crucible by a conventional segmented, cold-wall induction-heated guide (CIG). The refined melt extracted from the crucible in this manner provides an ideal liquid metal source for various solidification processes including, for example, powder atomization, spray deposition, investment casting, melt-spinning, strip casting, and slab casting.

In the exemplary electroslag apparatus introduced above, the crucible is conventionally water-cooled to form a solid slag skull on the surface thereof for bounding the liquid slag and preventing damage to the crucible itself as well as preventing contamination of the ingot melt from contact with the parent material of the crucible, which is typically copper. The bottom of the crucible typically includes a water-cooled, copper cold hearth against which a solid skull of the refined melt forms for maintaining the purity of the collected melt at the bottom of the crucible. The CIG discharge tube below the hearth is also typically made of copper and is segmented and water-cooled for also allowing the formation of a solid skull of the refined melt for maintaining the purity of the melt as it is extracted from the crucible.

A plurality of water-cooled induction heating electrical conduits surround the guide tube for inductively heating the melt thereabove for controlling the discharge flow rate of the melt through the tube. In this way, the thickness of the skull formed around the discharge orifice in the guide tube may be controlled and suitably matched with melting of the ingot for obtaining a substantially steady state production of refined melt which is drained by gravity through the guide tube.

In order to achieve steady state operation of the electroslag refining apparatus, the apparatus must be suitably started without introducing undesirable contamination or impurities. In a conventional cold start method, a solid starter plate is fixed into position at the bottom of the crucible and above the discharge guide tube.

Conventional slag in particulate form is deposited atop the starter plate around the electrode. An electrical current is passed through the electrode to the starter plate and then through the atmosphere to cause an electrical arc to jump therebetween. The heat from the arc melts the surrounding solid slag. When sufficient slag is melted, the electrode is lowered into the slag to extinguish the arc, at which time power to the electrode effects direct resistance heating of the slag pool for increasing its temperature.

The heated slag pool then continues to melt the tip of the electrode and the starter plate until a hole is melted through the starter plate and liquid metal fills the crucible atop the guide tube. The hole through the starter plate enlarges until it reaches the outer perimeter of the plate, and resulting refined metal and slag skulls line the crucible and the guide tube. Steady state operation is reached when the rate of melting of the electrode and discharge flowrate from the guide tube are substantially equal.

The starter plate is formed of the same material as the ingot electrode except that it has been pre-refined and suitably machined for integral assembly into the electroslag refining apparatus. It is therefore expensive.

For example, the starter plate may be cut from a billet formed by ESR. Since the refined alloy is typically a superalloy, it is extremely strong and difficult to machine. Accurate machining is required, however, to properly assemble the starter plate at the bottom of the crucible in a close-tolerance fit which effects both sealing and good electrical contact with the crucible for carrying the thousands of amps of electrical current during starting.

Accordingly, it is desired to provide a less expensive electroslag refining starter and method of making thereof.

SUMMARY OF THE INVENTION

An electroslag refining starter includes a refined disk fixedly joined in a central aperture of a mounting ring. The mounting ring supports the starter in a crucible below an ingot being electroslag refined. The disk is consumed during starting and is replaceable in the same mounting ring for subsequent reuse.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT(S)

Figure 1:
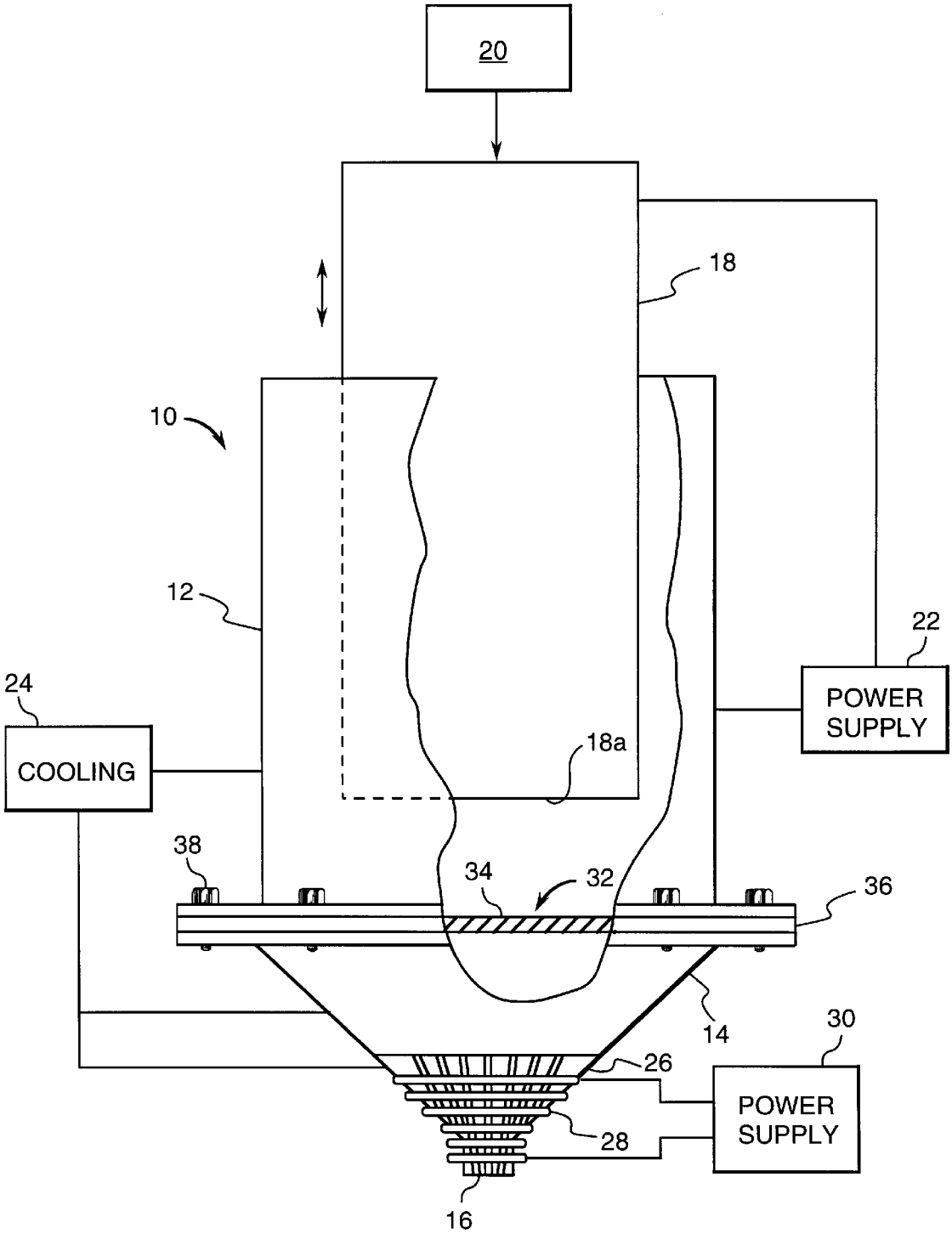
FIG. 1 is a schematic representation of an electroslag refining apparatus having an improved starter in accordance with an exemplary embodiment of the present invention.

Illustrated schematically in FIG. 1 is an electroslag refining apparatus 10 in accordance with an exemplary embodiment of the present invention. The apparatus 10 includes a cylindrical upper crucible 12 and a conical lower cold hearth 14 extending therebelow. The hearth 14 includes a central downspout or drain 16 extending downwardly.

Suitably suspended in the crucible 12 is an ingot 18 of a suitable alloy for undergoing electroslag refining. Conventional means 20 are provided for feeding or lowering the ingot 18 into the crucible 12 at a suitable feed rate. The lowering means 20 may have any suitable form including a drive motor and transmission rotating a screw, which in turn lowers or translates downwardly a support bar fixedly joined at one end to the top of the ingot 18.

The ingot 18 is formed of any suitable alloy requiring electroslag refining such as the superalloys listed above, including those known by the names of Alloy 718, Rene 88, and Rene 95, for example. A suitable slag is provided inside the crucible 12 and may take any conventional composition for refining a specific material of the ingot 18.

The ingot 18 includes a tip 18*a* at its lower end, and conventional heating means 22 are provided for melting the ingot tip 18*a* as it is lowered and fed into the crucible 12. The tip heating or melting means 22 is in the exemplary form of a suitable alternating or direct current power supply electrically joined to the ingot 18 through its support bar by a suitable electrical lead. Electrical current is carried through the ingot 18, which defines an electrode, and through the slag, in liquid form, to the crucible 12, with a return electrical lead to the power supply. In this way, the means 22 are effective for powering the ingot electrode 18 to effect resistance heating of the slag in its liquid form to a suitably high temperature to melt the electrode tip 18*a* suspended therein for consuming the electrode 18 as it is lowered during the electroslag refining process.

Suitable means 24 are provided for cooling the crucible 12, and the cold hearth 14, from the heat generated during the refining process. The crucible and hearth may take any conventional form including hollow copper jackets disposed in flow communication with the cooling means 24 which circulate therethrough cooling water for removing heat therefrom. The cooling means. 24 therefore include a suitable circulating pump and heat exchanger for removing heat as the water is circulated through the jackets.

The slag is initially in solid form and is initially melted in a startup process as described hereinbelow to develop a molten slag pool. The slag pool undergoes resistance heating as electrical current passes from the electrode 18 through the slag pool and to the crucible 12 in the electrical path to the power supply 22. The temperature of the slag pool is thereby increased to melt the electrode tip 18*a* which forms a pool of refined ingot material below the slag pool.

The refined pool is denser than the slag pool, and as the ingot electrode 18 is consumed at its tip by melting thereof, the melt travels downwardly through the slag pool which removes impurities therefrom for effecting electroslag refining, with the refined pool accumulating the refined melt therein. Since the crucible and hearth are water cooled, corresponding slag and refined metal skulls develop over the entire submerged inner surfaces thereof to provide a continuous lining separating the copper members from the refined melt pool and slag pool. This prevents contamination of the refined pool from the copper crucible and hearth themselves.

The cold hearth 14 preferably includes a circumferentially segmented, cold-wall induction-heated guide (CIG) tube 26 at the bottom thereof which includes the drain 16 for extracting or discharging the refined pool therefrom as a molten melt stream. The refined discharge stream may then be used for any suitable application including, for example, powder atomization, spray deposition, investment casting, melt-spinning, strip casting, and slab casting.

The guide tube 26 is conventionally configured and water cooled so that the refined skull extends downwardly through the drain 16 and defines an orifice through which the melt stream may be discharged without contamination from the guide tube 26 itself which is preferably copper. The thickness of the skull at the drain 16 may be controlled to control the size of the orifice and in turn control the discharge flow rate of the melt stream in a conventional manner.

More specifically, the guide tube 26 includes a plurality of circumferentially spaced apart guide fingers having a suitable electrical insulation therebetween. The fingers are preferably hollow for circulating cooling fluid such as water therethrough during operation. An induction heater 28 circumferentially surrounds the guide tube 26 and is conventional in configuration. It includes a hollow electrically conducting coiled tube operatively joined to a conventional electrical power supply 30.

The power supply 30 is effective for providing electrical current to the heater 28 for inductively heating the melt pool within the local area defined by the guide tube 26. The power supply 30 also includes suitable means for circulating a cooling fluid such as water through the hollow induction tube for cooling the heater itself as well as providing additional cooling of the guide tube 26.

But for the present invention as described hereinbelow, the electroslag refining apparatus 10 described above is conventionally configured and operated for electroslag refining the ingot electrode 18 to produce the discharge stream of refined metal for use as desired. The induction heater 28 is conventionally operated for controlling the local heating and cooling of the melt pool above the guide tube 26, and correspondingly controlling the diameter of the drain orifice to control discharge flow rate. However, in order to reach steady state operation of the apparatus 10, the apparatus 10 must be suitably started without introducing undesirable impurities which would degrade the resulting discharge stream.

In accordance with the present invention, an improved starter plate 32, or simply starter, is fixedly mounted to the bottom of the crucible 12 below the ingot 18 and above the cold hearth 14. The starter 32 is an assembly of two discrete components including a central disk or plug 34 and surrounding mounting ring 36. These components are illustrated in more particularity in FIGS. 2 and 3 with the mounting ring 36 being specifically configured and sized for being sandwiched or clamped between corresponding mounting flanges at the bottom of the crucible 12 and at the top of the cold hearth 14.

The mounting ring 36 is an annulus having a central aperture 36*a* which coaxially receives the disk 34 therein in a substantially coplanar arrangement. The mounting ring 36 also includes opposite upper and lower surfaces 36*b,c* which are flat to match the corresponding flat surfaces of the mounting flanges of the crucible 12 and hearth 14 for being joined together.

Figure 3:
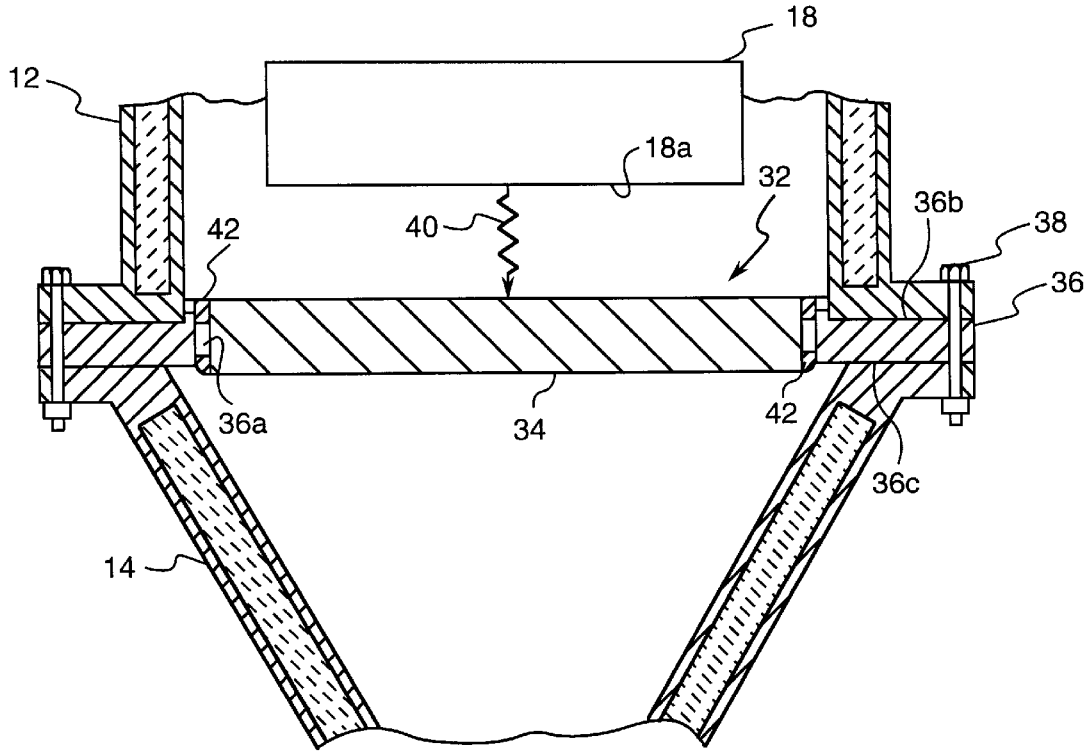
FIG. 3 is a an enlarged section view of the electroslag starter illustrated in FIG. 3 and taken along line 3—3.

In the preferred embodiment illustrated in FIG. 3, the upper and lower surfaces 36*b,c* have a substantially flat machined finish with suitably small tolerances less than a few mils. The corresponding mounting flanges of the crucible 12 and hearth 14 have similarly flat machined finishes so that when assembled together these components may be clamped using a plurality of circumferentially spaced apart fasteners 38, in the form of bolts and corresponding nuts, as required for effecting a substantially sealed joint thereat and providing sufficient contact area for carrying the substantial electrical current therethrough which may reach up to about 20,000 amps, for example, during electroslag starting.

A significant advantage of the two-piece starter 32 is that the mounting ring 36 may now be formed of a different material composition than that of the central starter disk 34 itself which substantially decreases the cost of manufacture as well as allows the mounting ring 36 to be reused in a refurbished starter for subsequent use. Since the starter disk 34 is consumed in most, if not all, part during the ESR start, it must necessarily have the same material composition as the ingot 18 being refined. Although the ingot 18 and starter disk 34 have matching material compositions, the ingot 18 is the subject of electroslag refining in the apparatus 10 whereas the starter disk 34 has previously been suitably refined, such as by ESR, to prevent the introduction of undesirable contaminates in the ESR process.

A conventional ESR starter plate is a one-piece component of refined alloy matching the material composition of the ingot 18. Typical alloys are referred to as superalloys since they have substantial strength which correspondingly increases the difficulty of machining thereof, at considerable cost. As shown in FIG. 3, an electrical arc 40 is initiated between the ingot electrode 18 and the starter disk 34 during ESR cold start to generate heat for melting the slag and the tip of the ingot. Eventually the heat melts a hole through the starter disk 34 consuming most of the disk within the crucible 12. After the ESR process is completed, the starter plate is removed, and in the case of a conventional one-piece starter plate it is discarded and not reused, except in recycling as warranted.

Figure 2:
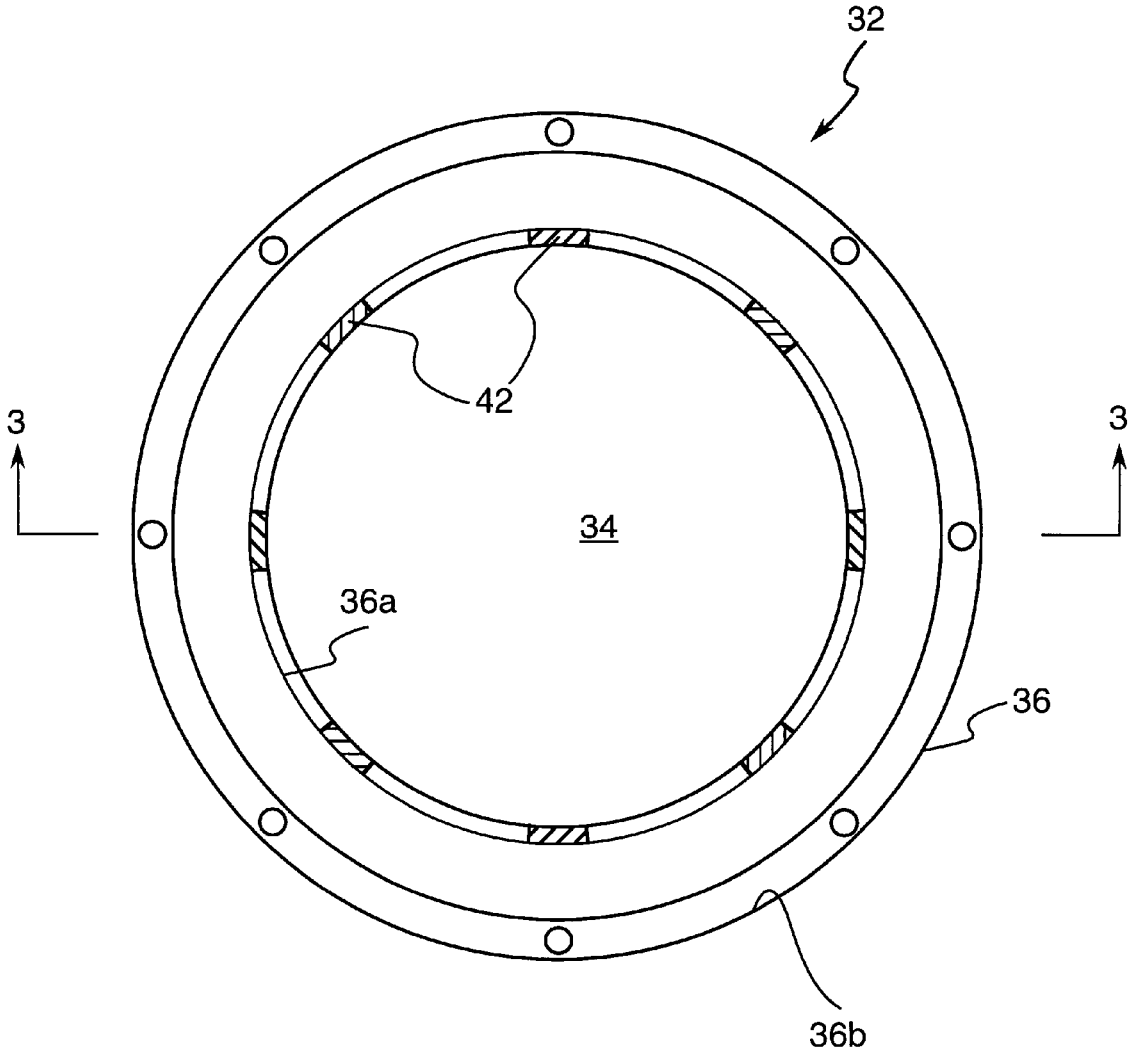
FIG. 2 is a top view of the starter illustrated in FIG. 1 having a mounting ring surrounding a central starter disk.

The improved starter 32 illustrated in FIGS. 2 and 3 allows the central starter disk 34 to be used in an otherwise conventional manner for cold starting the ESR process with consumption of the starter disk itself. However, upon completion of the ESR process, the starter 32 may be removed from the apparatus 10 and refurbished using the same mounting ring 36 with a replacement starter disk 34 for subsequent reuse. This saves substantial cost of manufacture and process use.

Although the starter disk 34 must be formed of pre-refined material matching the corresponding ingot 18, the mounting ring 36 need not. For example, the mounting ring 36 may be formed of a suitable material which itself does not require ESR refining and is therefore substantially less difficult and less costly to machine with the required configuration and surface finish for being mounted between the crucible 12 and the cold hearth 14. For example, the mounting ring 36 may be formed of a suitable stainless steel which is readily machinable with substantially flat machined upper and lower surfaces within small finish tolerances less than about a few mils.

As shown in the FIG. 3 embodiment, the crucible 12 is cylindrical with a corresponding inner diameter, and the starter disk 34 has an outer diameter which generally matches the inner diameter of the mounting ring 36 which are generally equal to the inner diameter of the crucible 12 for maximizing the surface area of the starter disk 34 inside the crucible 12. The mounting ring 36 may have any suitable configuration and extent for being suitably fixedly mounted at the juncture between the crucible 12 and the hearth 14.

As shown in FIGS. 2 and 3, the starter disk 34 is preferably imperforate and does not require any special machining thereof for being mounted inside the crucible 12. The size of the central aperture 36a matches as closely as practical the perimeter of the starter disk 34 for being assembled together substantially coplanar, with the disk 34 being suitably fixedly joined to the mounting ring 36 for support thereby. Since during ESR starting, thousands of amps of electrical current must be carried through the starter disk 34 to the mounting ring 36 and in turn to the power supply 22 (illustrated in FIG. 1), the starter disk 34 is preferably welded to the mounting ring 36 at a plurality of welds 42.

The welds 42 may completely seal the gap between the disk 34 and the mounting ring 36 if desired, or may be circumferentially spaced apart from each other as required for support and sufficient electrical current carrying capability. Since it is desirable to reuse the mounting ring 36 for subsequent ESR start, the number and extent of the individual welds 42 should be minimized so that they may be removed without significant damage to the mounting ring 36.

Since the starter disk 34 is now mounted to a separate and distinct mounting ring 36 of different material composition, accurate size and machining of the starter disk 34 itself are no longer required. As shown in FIG. 3, the disk 34 includes opposite upper and lower circular surfaces, at least one of which has a flat finish with larger variations than those of the machined finish of the mounting ring 36. The disk 34 may be made with any suitable thickness and may be simply saw cut from a previously electroslag refined billet without machining.

Figure 4:
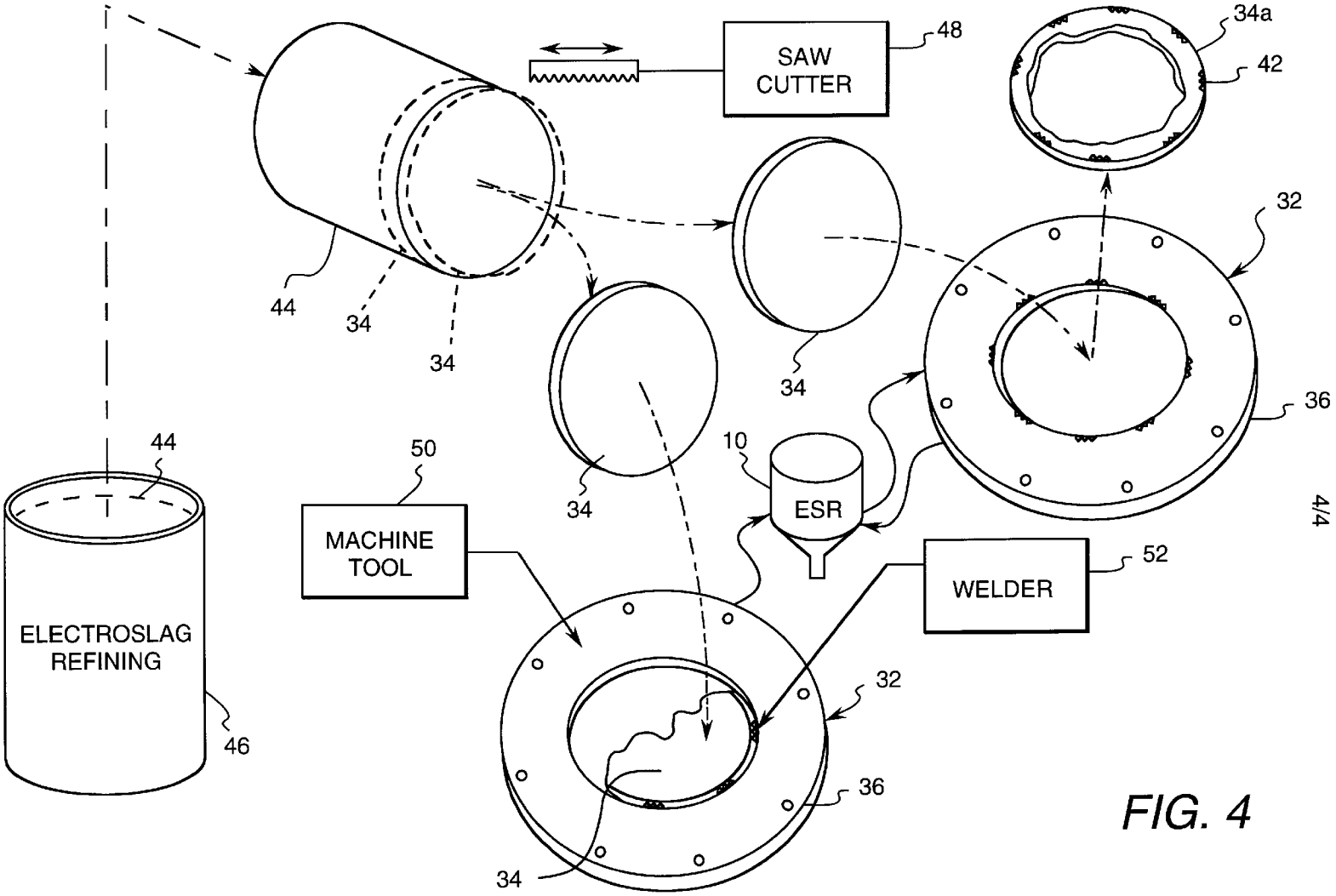
FIG. 4 is a schematic view of a process for making and refurbishing the starter illustrated in FIGS. 1–3.

More specifically, FIG. 4 illustrates schematically an exemplary method of making the improved starter 32. Firstly, a billet 44 of suitably refined material matching the material composition of the ingot 18 is suitably formed using another electroslag refining apparatus 46. The apparatus 46 may take any conventional form including a closed bottom crucible in which another ingot is lowered for undergoing conventional electroslag refining to produce the refined billet 44 therein. The billet 44 is then removed from the apparatus 46.

An individual starter disk 34 may then be cut from one end of the billet 44 using a conventional cutting saw 48 therefor. The mounting ring 36 is separately manufactured or formed in any conventional manner such as by casting or forging with subsequent machining in a conventional machine tool 50 for accurately forming the inner and outer diameters of the mounting ring 36 with the desired surface finishes for the upper and lower surfaces thereof.

The starter disk 34 saw cut from the billet 44 may then be suitably fixedly attached to the mounting disk 36 inside the central aperture thereof using a conventional welder 52 for forming a plurality of weld beads 42 at the juncture between the disk 34 and the ring 36. The assembled starter 32 may then be suitably mounted in the ESR apparatus 10 between the crucible 12 and the hearth 14 using the fasteners 38 mounted through corresponding apertures extending vertically therethrough.

Although the billet 44 illustrated in FIG. 4 may be suitably refined using any conventional process, it is preferably electroslag refined for best matching the subsequent electroslag refining of the corresponding ingot 18. The as-cast shape of the billet 44 is retained without any machining being required, and the individual starter disks 34 may simply be saw cut therefrom. Only the mounting ring 36 requires machining to suitably small tolerances for being accurately assembled between the crucible and cold hearth.

After the starter 32 is consumed in most part during the ESR process in the apparatus 10, the apparatus 10 may be suitably disassembled for removing the starter 32. The spent or consumed starter disk 34a illustrated in FIG. 4 may then be suitably removed from the mounting ring 36 by cutting, machining, or grinding of the weld beads 42. The consumed disk 34a may then be discarded or recycled as desired.

A replacement starter disk 34 previously saw cut from the billet 44 may then be similarly attached to the same mounting ring 36 by rewelding which refurbishes the starter 32 for use in another ESR start. The starter 32 may be refurbished and reused as many times as allowed by the integrity of the common mounting ring 36.

During electroslag refining, the solid skulls form radially inwardly from the inner surface of the crucible 12 and provide protection of the crucible 12 itself as well as protection of the mounting ring 36. The skull also prevents contamination of the refined melt pool from these components. By so protecting the mounting ring 36 during ESR start, melting thereof under the elevated temperature of the refined melt is prevented for maintaining structural integrity of the mounting ring 36 for subsequent reuse.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

What is claimed is:

1. An electroslag refining starter comprising an imperforate refined disk fixedly joined to a coplanar mounting ring therearound.

2. A starter according to claim 1 wherein said ring comprises a different material composition than said disk.

3. A starter according to claim 2 wherein said ring includes opposite upper and lower surfaces having a substantially flat machined finish.

4. A starter according to claim 3 wherein said disk includes opposite upper and lower surfaces, at least one of which has a flat finish with larger variations than said ring finish.

5. A starter according to claim 4 wherein said disk is welded to said ring for carrying electrical current therebetween during starting of electroslag refining.

* * * * *